US007280772B2

(12) United States Patent
Adkins et al.

(10) Patent No.: US 7,280,772 B2
(45) Date of Patent: Oct. 9, 2007

(54) METHOD FOR DETECTING WHETHER A CARTRIDGE INSTALLED IN AN IMAGING APPARATUS IS POTENTIALLY COUNTERFEIT

(75) Inventors: Christopher A. Adkins, Lexington, KY (US); Douglas K. Peterson, Jr., Irvine, KY (US); Timothy L. Strunk, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 220 days.

(21) Appl. No.: 11/025,163

(22) Filed: Dec. 29, 2004

(65) Prior Publication Data

US 2006/0140647 A1 Jun. 29, 2006

(51) Int. Cl.
*G03G 15/00* (2006.01)

(52) U.S. Cl. ..... 399/12; 399/24; 399/25

(58) Field of Classification Search ..... 399/9, 399/12, 24, 25; 347/19, 85, 86
See application file for complete search history.

(56) References Cited

U.S. PATENT DOCUMENTS 5,699,091 A 12/1997 Bullock et al.
6,158,837 A 12/2000 Hilton et al.
6,325,495 B1 12/2001 Foth
6,339,684 B1 1/2002 Sato et al.
6,406,120 B2 6/2002 Pauschinger
6,547,364 B2 4/2003 Silverbrook
6,565,181 B2 5/2003 Silverbrook
6,597,875 B2 7/2003 Hasegawa
6,612,494 B1 * 9/2003 Outwater ..... 235/462.04
6,625,402 B2 9/2003 Takemoto
6,636,702 B2 10/2003 Abe
6,658,219 B1 12/2003 Ito et al.
6,687,017 B1 2/2004 Kakiuchi et al.
6,702,417 B2 3/2004 Silverbrook
6,711,362 B2 3/2004 Asakura
6,738,903 B1 * 5/2004 Haines ..... 713/168
2002/0063760 A1 * 5/2002 Dietl et al. ..... 347/86
2002/0188860 A1 * 12/2002 Parry et al. ..... 713/200
2005/0206694 A1 * 9/2005 Wadley ..... 347/85
2006/0044332 A1 * 3/2006 Auslander et al. ..... 347/6
2006/0098993 A1 * 5/2006 Yang ..... 399/12

* cited by examiner

*Primary Examiner*—Hoan Tran
(74) *Attorney, Agent, or Firm*—Taylor & Aust, PC

(57) ABSTRACT

A method for detecting whether a cartridge installed in an imaging apparatus is potentially counterfeit includes determining whether a usage threshold has been reached by the cartridge; determining whether the cartridge was previously installed in the imaging apparatus; and determining that the cartridge is potentially counterfeit if the usage threshold has been reached and the cartridge was not previously installed in the imaging apparatus.

40 Claims, 7 Drawing Sheets

METHOD FOR DETECTING WHETHER A CARTRIDGE INSTALLED IN AN IMAGING APPARATUS IS POTENTIALLY COUNTERFEIT

BACKGROUND OF THE INVENTION

1. Field of the Invention

The present invention relates to an imaging apparatus, and, more particularly, to a detecting whether a cartridge installed in an imaging apparatus is potentially counterfeit.

2. Description of the Related Art

An imaging device typically employs one or more cartridges, such as, for example, replaceable inkjet printhead cartridges or EP toner cartridges.

Counterfeits of original equipment manufacturer (OEM) cartridges are packaged to appear as OEM cartridges, but rather, may be made using inferior materials and processes, and may include an inferior colorant. The use of such counterfeit cartridges often results in a reduced quality of printed output of the imaging device, which is undesirable to the consumer. In addition, the use of inferior colorants may damage or clog the colorant dispersal systems, further degrading performance of the imaging device, which is also undesirable to the consumer, and contributes to an unpleasant printing experience.

SUMMARY OF THE INVENTION

The present invention provides a method for detecting whether a cartridge installed in an imaging apparatus is potentially counterfeit.

The invention, in one exemplary embodiment, relates to a method for detecting whether a cartridge installed in an imaging apparatus is potentially counterfeit. The method includes determining whether a usage threshold has been reached by the cartridge; determining whether the cartridge was previously installed in the imaging apparatus; and determining that the cartridge is potentially counterfeit if the usage threshold has been reached and the cartridge was not previously installed in the imaging apparatus.

In another exemplary embodiment, a method for detecting whether a cartridge installed in an imaging apparatus is counterfeit includes determining whether a cartridge identification number associated with the cartridge is on a counterfeit list.

The invention, in yet another exemplary embodiment, relates to an imaging apparatus that detects whether a cartridge installed in the imaging apparatus is potentially counterfeit. The imaging apparatus includes a print engine configured to mount the cartridge, and a controller communicatively coupled to the print engine. The controller is configured to execute instructions for determining whether a usage threshold has been reached by the cartridge; determining whether the cartridge was previously installed in the imaging apparatus; and determining that the cartridge is potentially counterfeit if the usage threshold has been reached and the cartridge was not previously installed in the imaging apparatus.

In still another exemplary embodiment, an imaging apparatus that detects whether a cartridge installed in an imaging apparatus is counterfeit includes a print engine configured to mount the cartridge, and a controller communicatively coupled to the print engine. The controller is configured to execute instructions for determining whether a cartridge identification number associated with the cartridge is on a counterfeit list.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
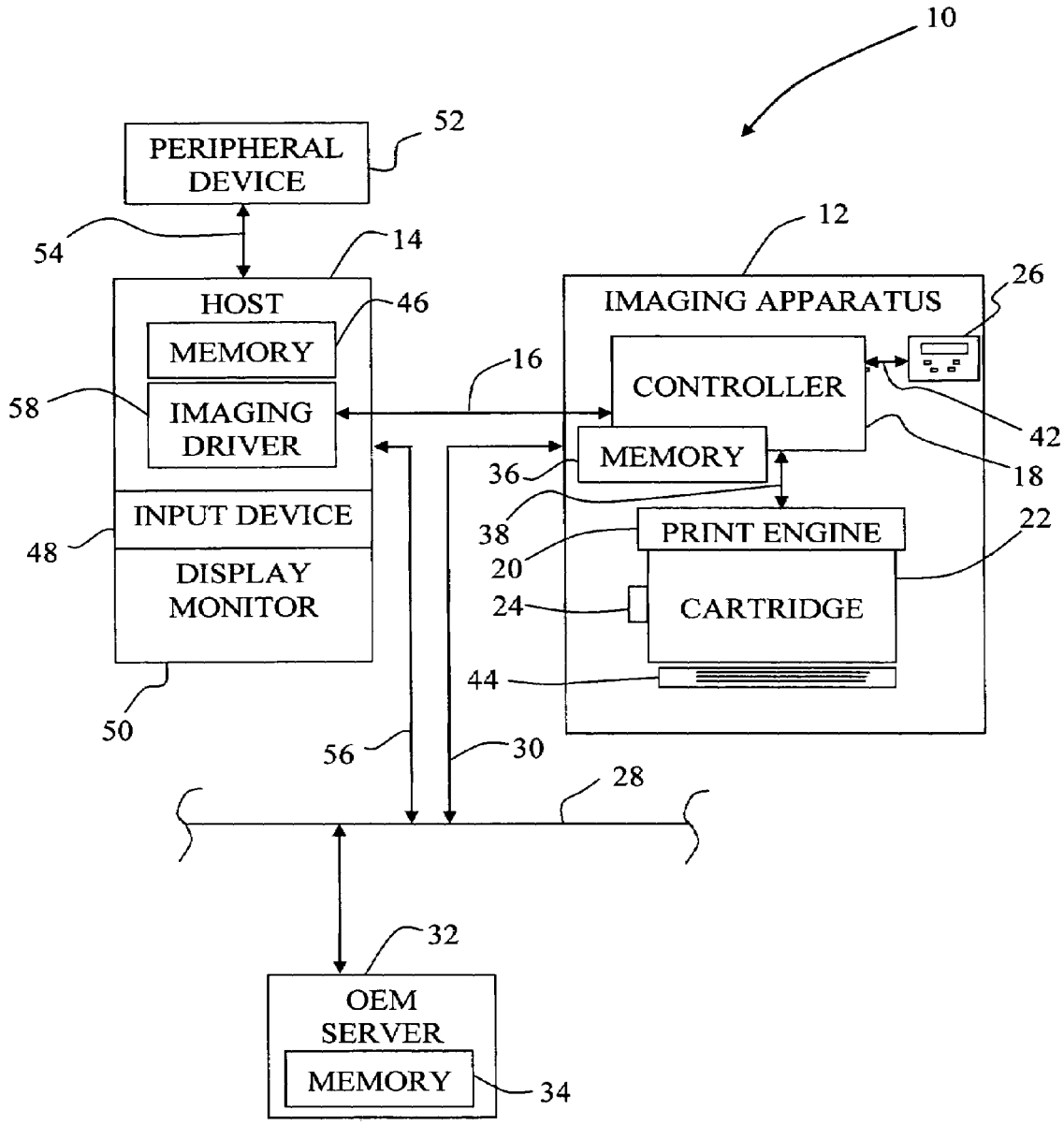
FIG. 1 is a diagrammatic depiction of an imaging system in accordance with an embodiment of the present invention.

Referring now to the drawings, and particularly to FIG. 1, there is shown a diagrammatic depiction of an imaging system 10 in accordance with an embodiment of the present invention. Imaging system 10 includes an imaging apparatus 12 and a host 14. Imaging apparatus 12 communicates with host 14 via a communications link 16.

Imaging apparatus 12 can be, for example, an ink jet printer and/or copier, an electrophotographic (EP) printer and/or copier, or an all-in-one (AIO) unit that includes a printer, a scanner, and possibly a fax unit. Imaging apparatus 12 includes a controller 18, a print engine 20, a replaceable cartridge 22 having cartridge memory 24, and a user interface 26. Cartridge 22 may be, for example, an inkjet printhead cartridge, an ink cartridge, an EP cartridge, or any consumable or user-replaceable component of imaging apparatus 12.

Controller 18 is communicatively coupled to print engine 20, and print engine 20 is configured to mount cartridge 22. Imaging apparatus 12 has access to a network 28, via a communication line 30, to interface with an OEM server 32 having a memory 34, in order to transmit and/or receive data for use in carrying out its imaging functions. Network 28 may be, for example, the Internet, an intranet, or any local area network (LAN) or wide area network (WAN), or a series of networks of the same or different type capable of intercommunication. In the present embodiment, OEM server 32 is a server associated with the original equipment manufacturer (OEM) of imaging apparatus 12 and/or cartridge 22. Alternatively, however, it is contemplated that OEM server 32 is, for example, a server associated with an OEM authorized component manufacturer, retailer, distributor, and/or warehouse. OEM server 32 stores OEM authorized cartridge identification numbers, e.g., serial numbers, for each cartridge 22 manufactured by the OEM and its authorized component manufacturers. OEM server also stores a counterfeit list, which is a listing of cartridge identification numbers believed to be employed by counterfeiters in producing counterfeit cartridges that are sold or otherwise distributed under the guise of an OEM cartridge 22.

Controller 18 includes a processor unit and associated memory 36, and may be formed as one or more Application Specific Integrated Circuits (ASIC). Controller 18 may be a printer controller, a scanner controller, or may be a combined printer and scanner controller, for example, such as for use in a copier. Although controller 18 is depicted as residing in imaging apparatus 12, alternatively, it is contemplated that all or a portion of controller 18 may reside in host 14. Nonetheless, as used herein, controller 18 is considered to be a part of imaging apparatus 12. Controller 18 communicates with print engine 20, cartridge 22, and cartridge memory 24 via a communications link 38, and with user interface 26 via a communications link 42. Controller 18 serves to process print data, to operate print engine 20 during printing, and to execute instructions to detect whether a cartridge 22 installed in imaging apparatus 12 is counterfeit.

Memory 36 stores various data pertaining to imaging apparatus 12, and also stores data pertaining to each particular cartridge 22 that has been installed in imaging apparatus 12, such as, for example, a previous cartridge list having usage data for each previously installed cartridge 22 indexed by the corresponding cartridge identification numbers.

In the context of the examples for imaging apparatus 12 given above, print engine 20 can be, for example, an ink jet print engine or an electrophotographic print engine, configured for forming an image on a substrate 44, which may be one of many types of print media, such as a sheet of plain paper, fabric, photo paper, coated ink jet paper, greeting card stock, transparency stock for use with overhead projectors, iron-on transfer material for use in transferring an image to an article of clothing, and back-lit film for use in creating advertisement displays and the like. As an ink jet print engine, print engine 20 operates cartridge 22 to eject ink droplets onto substrate 44 in order to reproduce text or images, etc. As an electrophotographic print engine, print engine 20 causes cartridge 22 to deposit toner onto substrate 44, which is then fused to substrate 44 by a fuser (not shown). In the embodiment depicted, imaging apparatus 12 is an ink jet unit.

Host 14 may be, for example, a personal computer, including memory 46, an input device 48, such as a keyboard, and a display monitor 50. One or more of a peripheral device 52, such as a digital camera, may be coupled to host 14 via communication links, such as communication link 54. Host 14 further includes a processor, input/output (I/O) interfaces, and is connected to network 28 via a communication line 56, and hence, has access to OEM server 32, including memory 34. Memory 46 can be any or all of RAM, ROM, NVRAM, or any available type of computer memory, and may include one or more of a mass data storage device, such as a floppy drive, a hard drive, a CD drive and/or a DVD drive. As set forth above, memory 36 of imaging apparatus 12 stores data pertaining to each particular cartridge 22 that has been installed in imaging apparatus 12. However, it is alternatively contemplated that memory 46 of host 14 may store such data.

During operation, host 14 includes in its memory 46 a software program including program instructions that function as an imaging driver 58, e.g., printer/scanner driver software, for imaging apparatus 12. Imaging driver 58 is in communication with controller 18 of imaging apparatus 12 via communications link 16. Imaging driver 58 facilitates communication between imaging apparatus 12 and host 14, and provides formatted print data to imaging apparatus 12, and more particularly, to print engine 20. Although imaging driver 58 is disclosed as residing in memory 46 of host 14, it is contemplated that, alternatively, all or a portion of imaging driver 58 may be located in controller 18 of imaging apparatus 12.

In accordance with one embodiment of the present invention, cartridge memory 24 may be utilized to detect potential counterfeiting. Information stored in cartridge memory 24 for detecting counterfeiting exists in the form of usage data ("gas gauge" data) and the existing unique cartridge identification number.

The usage data pertains to the usage of cartridge 22 in an imaging apparatus, such as imaging apparatus 12. For example, the usage data may store the number of nozzle firings executed by cartridge 22 while printing in an imaging apparatus. In addition, the usage data indicates whether cartridge 22 has reached a particular usage threshold, e.g., used up its OEM authorized supply of ink.

Depending on the cartridge type, cartridge 22 may be designed for a single usage or may be designed for multiple usages. A single usage cartridge is a cartridge that is typically disposed of after reaching its usage threshold, e.g. after exhausting its built-in supply of colorant. A multiple usage cartridge is a cartridge that is designed to be refilled one or more times, and hence, has a plurality of usage thresholds corresponding to the plurality of usages of the cartridge.

For a multiple usage cartridge, once the first usage threshold is reached, e.g., once the initial colorant supply is exhausted, the cartridge may be returned to the OEM manufacturer or an authorized agent for refill, wherein a colorant supply for second usage of the cartridge is added to the cartridge. The cartridge will then be sold as a remanufactured cartridge, and may be used until the second usage threshold is reached, e.g., until the added colorant is exhausted. The process of refilling and reusing the cartridge may take place many times. A multiple-usage cartridge employs a cartridge memory 24 that has two or more data storage areas, wherein each storage area is for storing usage data for each of the first, second, and any subsequent usages. The process of refilling and reusing a cartridge may be performed as many times as there are memory areas for storing usage data. For each multiple-usage cartridge, memory 36 stores in the previous cartridge list usage data for each of the first, second, and any subsequent usages for each corresponding cartridge identification number of cartridge 22.

Figure 2B:
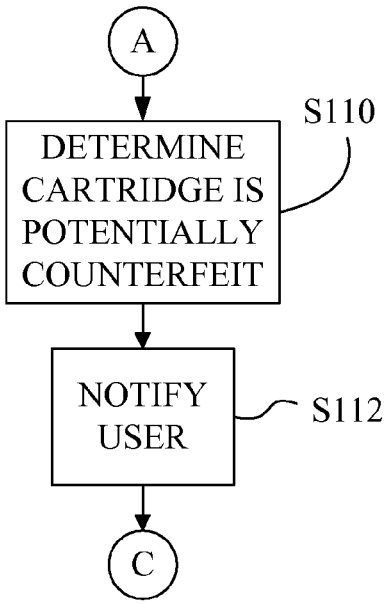
FIGS. 2A-2G depict a flowchart representing a method of detecting whether a cartridge installed in an imaging apparatus is counterfeit in accordance with an embodiment of the present invention.
Figure 2C:
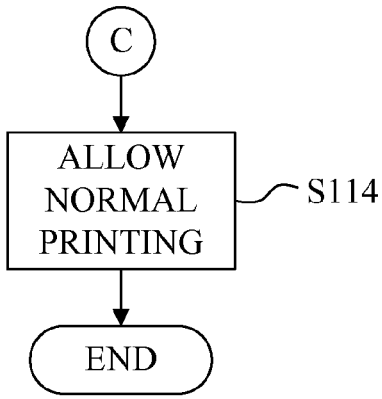
Figure 2A:
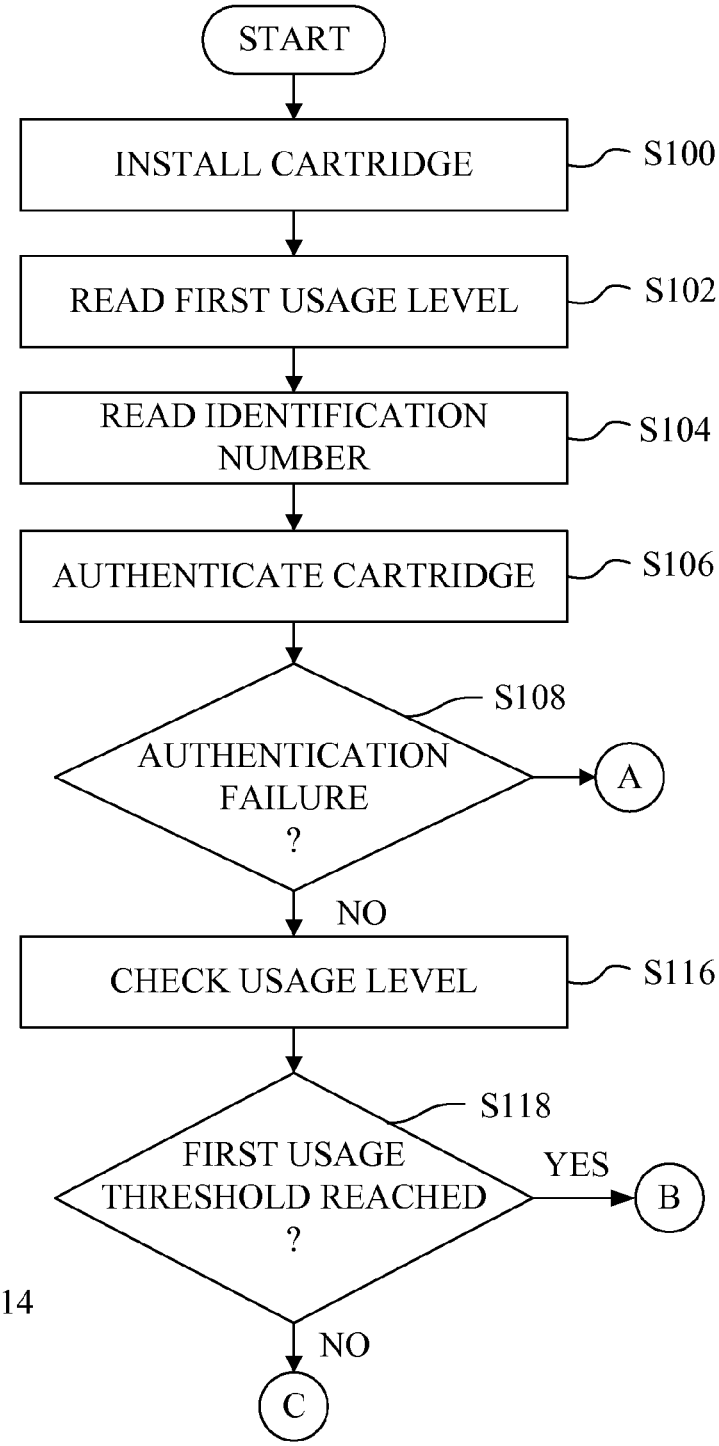

Referring now to FIGS. 2A-2G, and more particularly, to FIG. 2A, there is shown a flowchart depicting a method for detecting whether cartridge 22 installed in imaging apparatus 12 is potentially counterfeit in accordance with an embodiment of the present invention. The ultimate determination of whether cartridge 22 is counterfeit may be made, for example, upon further inspection of cartridge 22 by the OEM. In the examples that follow, the steps may be performed by a processing unit, such as, for example, controller 18, which executes programmed instructions, with the exception of installing cartridge 22 into imaging apparatus 12. As set forth above, controller 18 may be, in whole or in part, in imaging apparatus 12 or host 14.

At step S100, cartridge 22 is installed into imaging apparatus 12.

At step S102, the first usage level data is read from cartridge memory 24. For example, the data includes "gas gauge" data that indicates the level of usage of cartridge 22, e.g., a remaining amount of colorant.

At step S104, the cartridge identification number is read from cartridge memory 24 of cartridge 22.

At step S106, an authentication of cartridge 22 is performed.

At step S108, if the authentication of step S106 fails, process flow proceeds to step S110. Otherwise, process flow proceeds to step S116.

Referring now to FIG. 2B, at step S110, if the authentication performed in step S106 fails, cartridge 22 is determined to be potentially counterfeit.

At step S112, the user of imaging apparatus 12 is notified that the installed cartridge 22 is potentially counterfeit. The notification may be effected via, for example, user interface 26 and/or display monitor 50. During notification, the user may be encouraged to notify the OEM manufacturer, retailer, and/or distributor of cartridge 22 of the presence of a potentially counterfeit cartridge.

Referring now to FIG. 2C, at step S114, notwithstanding that cartridge 22 was determined to be counterfeit, normal printing is allowed, i.e., normal printing using cartridge 22 is allowed.

Referring again to FIG. 2A, at step S116, if the authentication performed in step S106 does not fail, the usage level of cartridge 22 that was read from cartridge memory 24 is checked, which indicates, for example, how much printing was performed using cartridge 22, or whether or not there is any remaining colorant in cartridge 22, and if so, how much colorant is left.

At step S118, it is determined whether or not the usage threshold has been reached by cartridge 22, e.g., whether or not the initial supply of colorant in cartridge 22 has been exhausted. If so, process flow proceeds to step S120. Otherwise, process flow proceeds to step S114 (FIG. 2B), wherein normal printing is allowed.

Figure 2D:
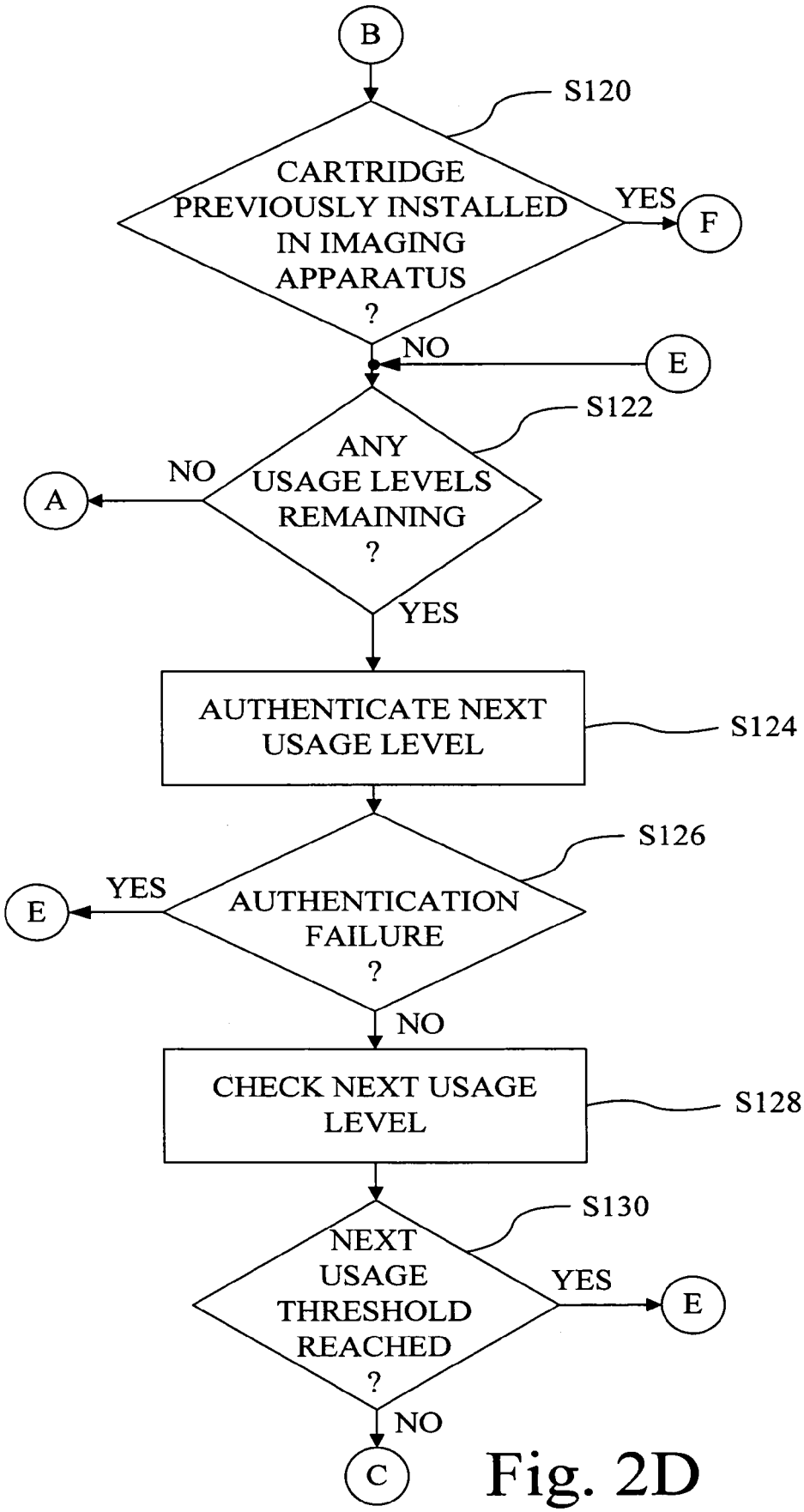

Referring now to FIG. 2D, at step S120, it is determined whether cartridge 22 was previously installed in imaging apparatus 12. In another embodiment, it is determined whether cartridge 22 was previously installed in imaging apparatus 12 prior to cartridge 22 reaching the usage threshold. In the present embodiment, step S120 is performed by determining if the cartridge identification number associated with cartridge 22 is stored in memory 36 of imaging apparatus 12, although in another embodiment, step S120 may alternatively be performed by determining if the cartridge identification number associated with cartridge 22 is stored in memory 36 of imaging apparatus 12 prior to cartridge 22 reaching the usage threshold. Although the disclosed embodiments employ memory 36 of imaging apparatus 12, alternatively, however, it is contemplated that it may be determined if the cartridge identification number associated with cartridge 22 is stored in memory 46 of host 14. Step 120 is set forth below in greater detail in steps S120-1 to S120-5 as shown in FIG. 2E.

Figure 2E:
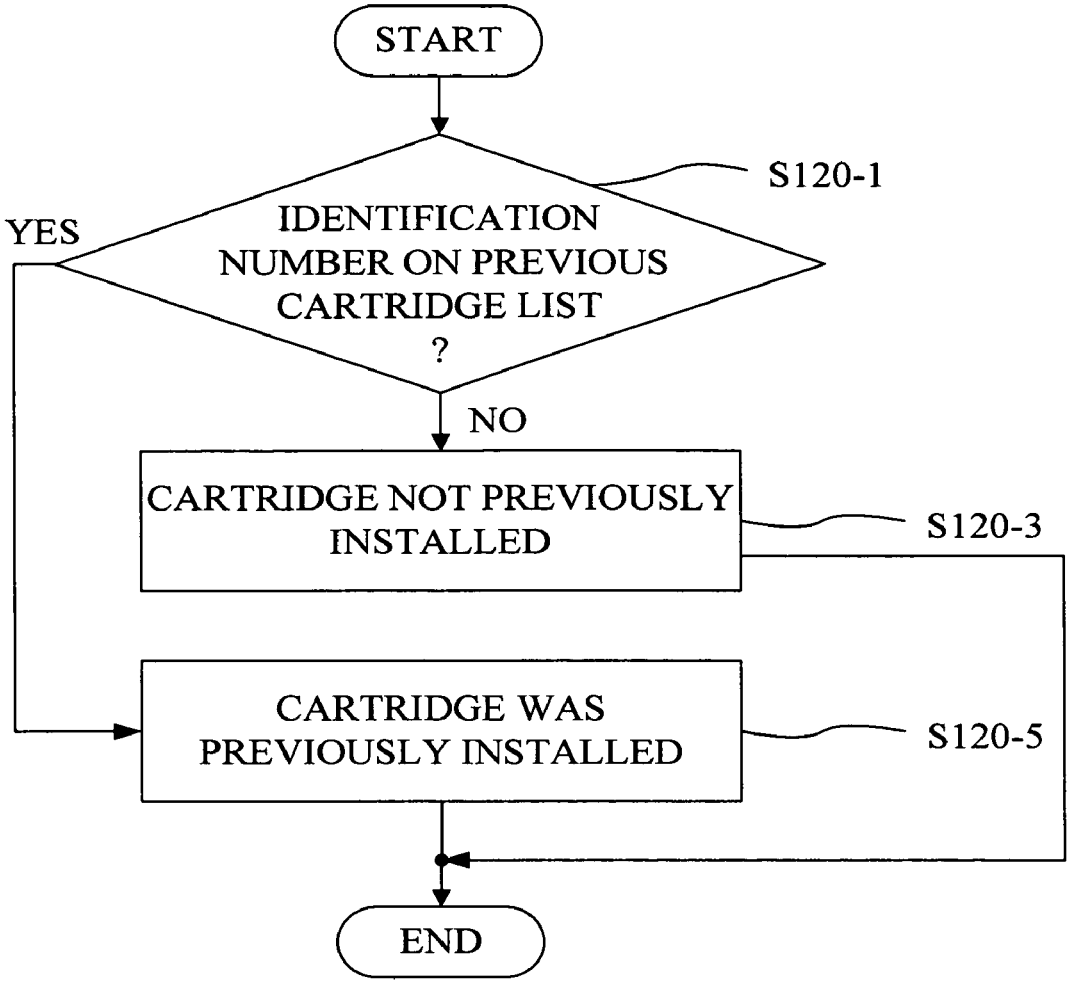

Referring now to FIG. 2E, at step S120-1, the cartridge identification number is compared to values stored in memory 36 of imaging apparatus 12, in particular, a previous cartridge list stored in memory 36. Alternatively, however, it is considered that the previous cartridge list may be stored in memory 46 of host 14.

At step S120-3, it is determined that cartridge 22 was not previously installed in imaging apparatus 12 if the cartridge identification number is not on the previous cartridge list.

At step S120-5, it is determined that that cartridge 22 was previously installed in imaging apparatus 12 if the cartridge identification number is on the previous cartridge list.

Referring again to FIG. 2D, if it is determined that cartridge 22 was not previously installed in imaging apparatus 12, process flow proceeds to step S122. Otherwise, process flow proceeds to step S132 of FIG. 2F.

At step S122, it is determined whether there are any remaining usage levels available in cartridge 22. If not, process flow proceeds to steps S110 and S112, wherein the cartridge is determined to be counterfeit and the user is notified, respectively, as set forth above with reference to steps S110 and S112 of FIG. 2B, after which process flow proceeds to step S114 (FIG. 2C), wherein normal printing is allowed as set forth above.

Accordingly, for a single usage cartridge, the present invention determines that cartridge 22 is potentially counterfeit if the usage threshold has been reached and cartridge 22 was not previously installed in imaging apparatus 12 prior to cartridge 22 reaching the usage threshold.

If there are any remaining usage levels available in cartridge 22, process flow proceeds to step S124. As set forth previously, a multiple use cartridge will have two or more usages. Hence, if the first usage threshold has been reached, a second or subsequent usage may be available.

At step S124, an authentication of the next usage, e.g., a second or subsequent usage of the plurality of usages of cartridge 22, is performed.

At step S126, if the authentication of step S124 fails, process flow proceeds back to step S122. Otherwise, process flow proceeds to step S128. If cartridge 22 is a multiple usage cartridge, and there are no usage levels remaining, process flow proceeds from step S122 to step S110, wherein it is determined that cartridge 22 is potentially counterfeit. Accordingly, it is determined that cartridge 22 is potentially counterfeit if the authentication of the second or subsequent usage fails. Process flow then proceeds to steps S112 (FIG. 2B) and S114 (FIG. 2C), wherein the user is notified that the cartridge is potentially counterfeit, and then normal printing is allowed.

At step S128, the usage level of cartridge 22 of the second or subsequent usage is checked, which indicates, for example, whether or not there is any remaining colorant in the second or subsequent usage of cartridge 22, and if so, how much colorant is left.

At step S130, it is determined whether or not the second or subsequent usage threshold has been reached by cartridge 22, e.g., whether or not the second or subsequent supply of colorant in cartridge 22 has been exhausted. If so, process flow proceeds back to step S122. Otherwise, process flow proceeds to step S114 (FIG. 2B), wherein normal printing is allowed.

Figure 2G:
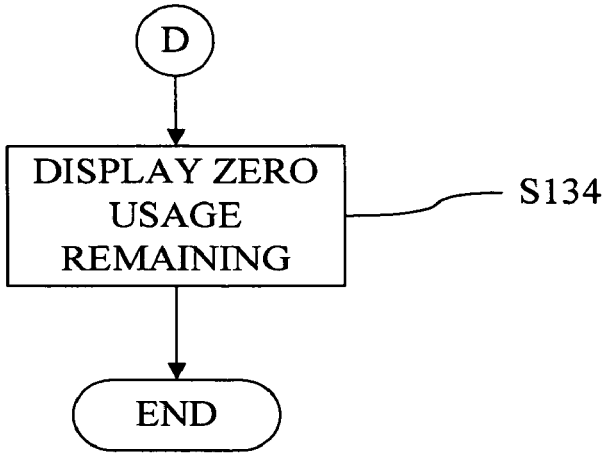
Figure 2F:
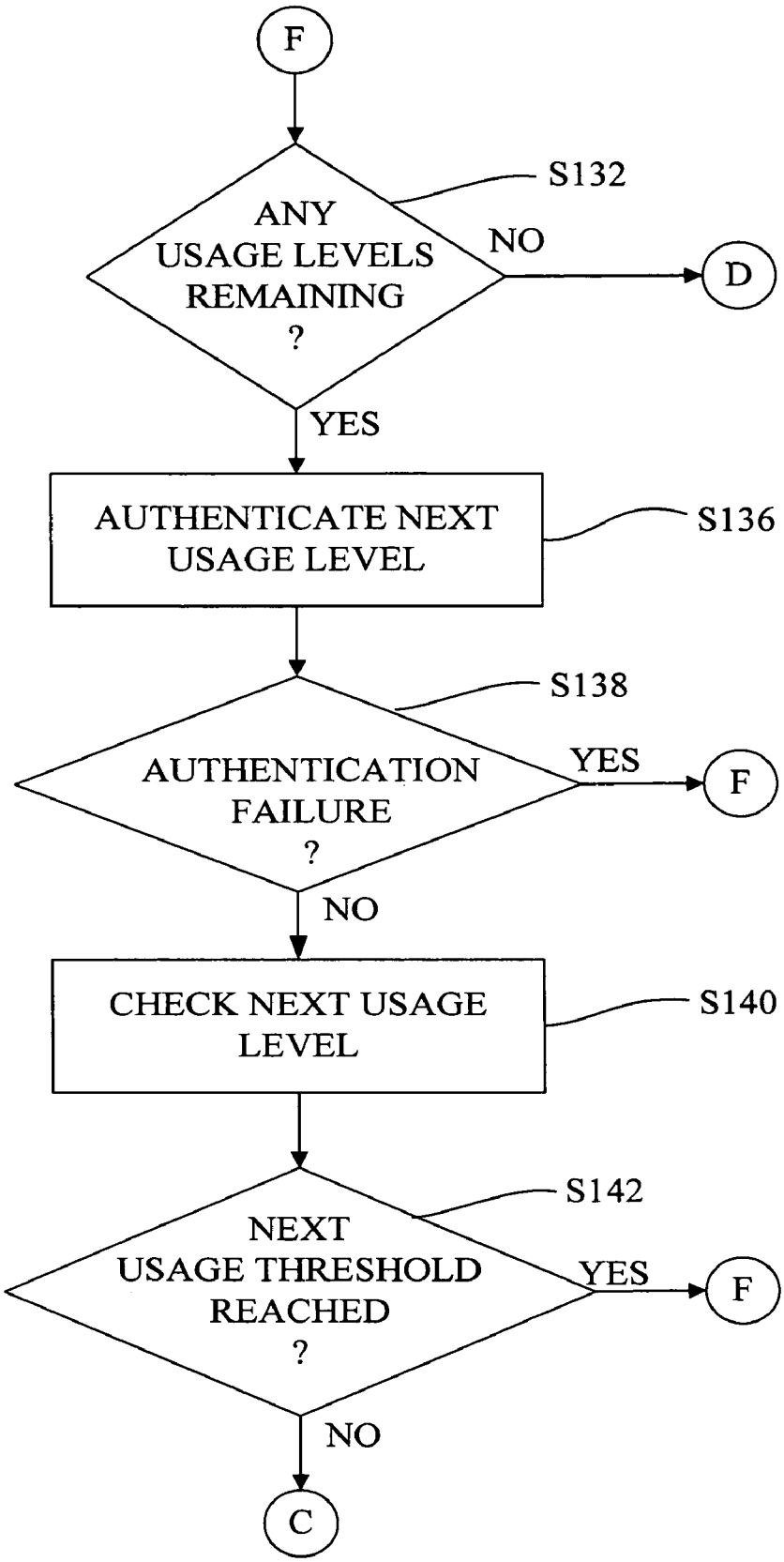

Referring now to FIG. 2F, if was is determined at step S120 that cartridge 22 was previously installed in imaging apparatus 12, process flow proceeds to step S132.

At step S132, it is determined whether there are any remaining usage levels available in cartridge 22. If not, process flow proceeds to step S134. Otherwise process flow proceeds to step S136.

Referring now to FIG. 2G, at step S134, since there are no remaining usages available for cartridge 22 as determined in step S132, it is displayed to the user that zero usage of cartridge 22 is remaining, for example, via user interface 26 and/or display monitor 50.

Referring again to FIG. 2F, at step S136, since there are remaining usages available for cartridge 22 as determined in step S132, an authentication of the next usage, e.g., a second or subsequent usage of the plurality of usages of cartridge 22, is performed.

At step S138, if the authentication of step S126 fails, process flow proceeds back to step S132. Otherwise, process flow proceeds to step S140.

At step S140, if the authentication performed in step S136 does not fail, the usage level of cartridge 22 that was read from cartridge memory 24 is checked, which indicates, for example, how much printing was performed using cartridge 22, or whether or not there is any remaining colorant in cartridge 22, and if so, how much colorant is left.

At step S142, it is determined whether or not the second or subsequent usage threshold has been reached by cartridge 22, e.g., whether or not the second or subsequent supply of colorant in cartridge 22 has been exhausted. If so, process flow proceeds back to step S132. Otherwise, process flow proceeds to step S134 (FIG. 2G), wherein it is displayed to the user that zero usage of cartridge 22 is remaining.

Figure 3A:
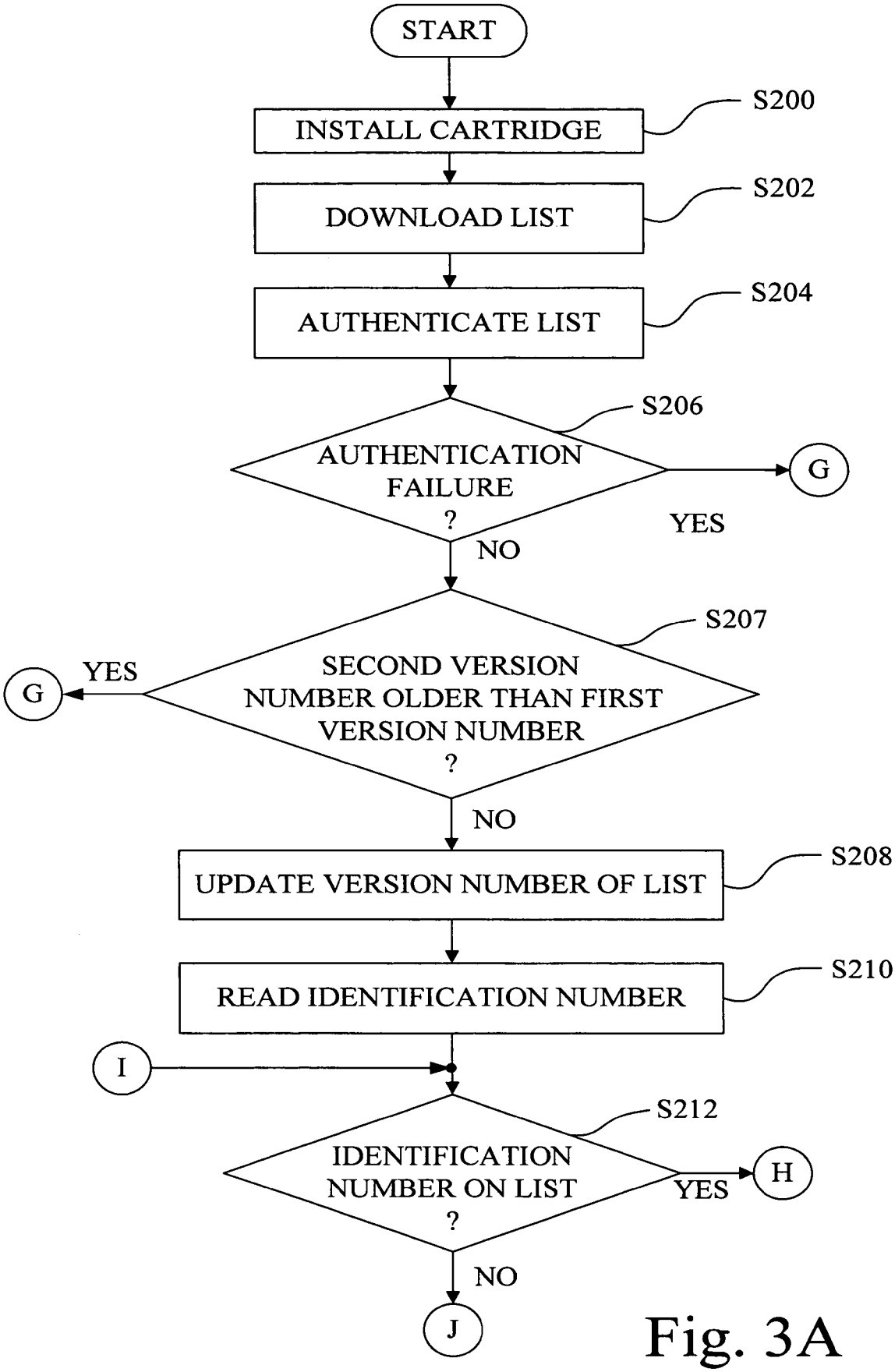
FIGS. 3A-3D depict a flowchart representing a method of detecting whether a cartridge installed in an imaging apparatus is counterfeit in accordance with another embodiment of the present invention.

Referring now to FIGS. 3A-3D, and more particularly, to FIG. 3A, there is shown a flowchart depicting a method for detecting whether cartridge 22 installed in imaging apparatus 12 is counterfeit in accordance with another embodiment of the present invention. Generally, the method depicted in FIGS. 3A-3D, includes determining whether the cartridge identification number associated with cartridge 22 is on a counterfeit list in order to determine whether the cartridge is counterfeit. The counterfeit list is a list of known cartridge identification numbers that have been repetitively used, e.g., used by counterfeiters, and hence, if the cartridge identification number associated with cartridge 22 is on the counterfeit list, it is deemed to be a counterfeit cartridge.

A first counterfeit list and a first version number assigned to the first counterfeit list are stored in a memory associated with one of imaging apparatus 12 and host 14, wherein the version number pertains to a version of the first counterfeit list. For example, the counterfeit list may be stored in memory 36 of controller 18 and/or imaging driver 58 when imaging apparatus 12 is manufactured. If stored in imaging driver 58, the counterfeit list copied onto host 14 when imaging driver 58 is installed on host 14.

As set forth below, the counterfeit list is updated under various circumstance, such as, for example, when one of imaging apparatus 12 and host 14 contacts server 32 via network 28.

At step S200, cartridge 22 is installed into imaging apparatus 12.

At step S202, a counterfeit list, including its version number, is downloaded, for example, from host 14 via imaging driver 58. Hence, imaging apparatus 12 receives a second counterfeit list intended as a replacement for the first counterfeit list, and a corresponding second version number for storage in memory 36.

At step S204, an authentication of the counterfeit list is performed.

At step S206, if it is determined that there was a failure of the authentication of step S204, process flow proceeds to step S220 wherein it is determined that the second counterfeit list is invalid. Otherwise, process flow proceeds to step S207.

At step S207, it is determined if the second version number is older than the first version number, for example, a prior version number in a sequence of version numbers. If so process flow proceeds to step S220 wherein it is determined that the second counterfeit list is invalid. Otherwise, process flow proceeds to step S208.

At step S208, the version number of the counterfeit list is updated to generate another version number if the version number downloaded in step S202 is greater than the version number of the counterfeit list originally stored in memory 36 of imaging apparatus 12, or alternatively, memory 46 of host 14.

At step S210, the cartridge identification number is read from cartridge memory 24 of cartridge 22.

At step S212, it is determined whether cartridge identification number read in step S210 is on the counterfeit list. If not, process flow proceeds to step S214. If the cartridge identification number is on the counterfeit list, process flow proceeds to step S216.

Figure 3D:
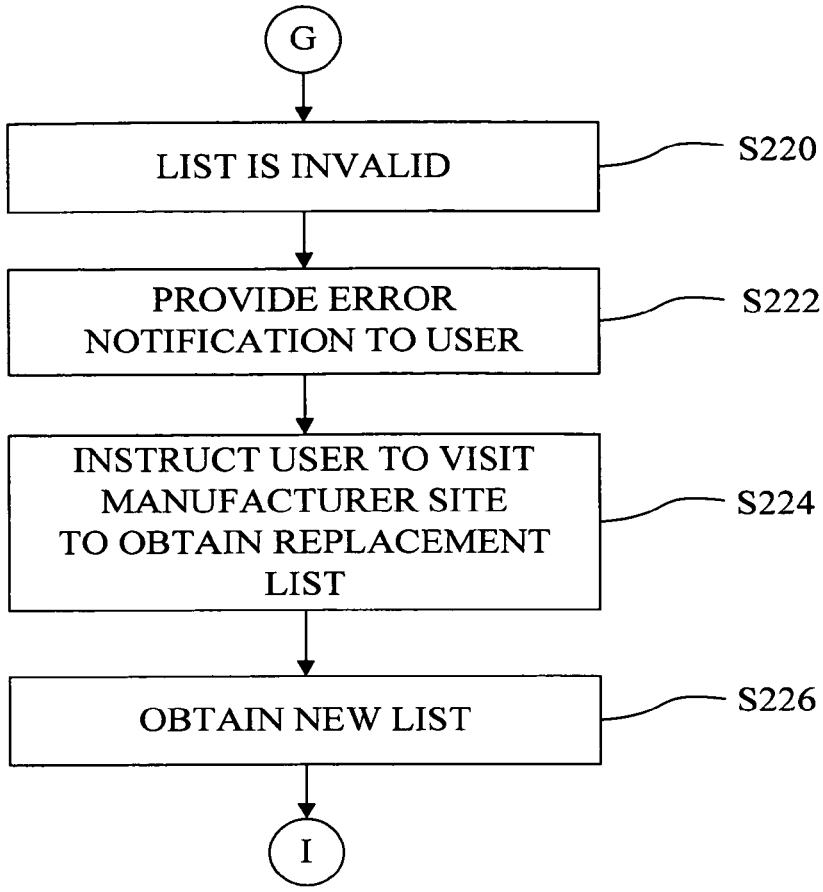
Figure 3B:
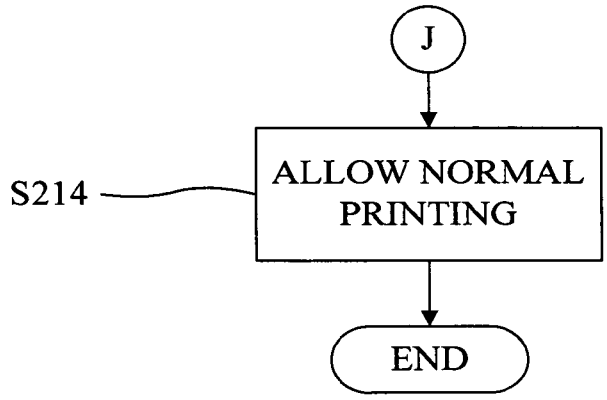

Referring now to FIG. 3B, at step S214, normal printing is allowed.

Figure 3C:
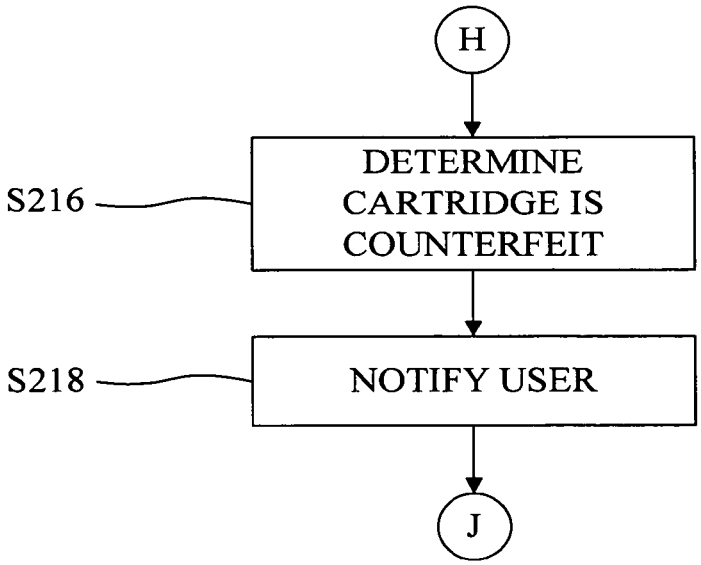

Referring now to FIG. 3C, at step S216, if the cartridge identification number of cartridge 22 is on the counterfeit list, it is determined that cartridge 22 is counterfeit.

At step S218, the user of imaging apparatus 12 is notified that the installed cartridge 22 is counterfeit. The notification may encourage the user to notify the OEM manufacturer, retailer, and/or distributor of cartridge 22 of the counterfeit cartridge. The notification is effected via, for example, user interface 26 and/or display monitor 50. After notifying the user, process flow proceeds to step S214 (FIG. 3B) to allow normal printing.

Referring again to FIG. 3A, if at step S206 it is determined that there was a failure of the authentication of the counterfeit list, the counterfeit list deemed invalid and is updated as set forth below.

Referring now to FIG. 3D, at step S220, it is determined that the second counterfeit list is invalid.

At step S222, an error notification is provided to the user of imaging apparatus 12, e.g., to indicate that the counterfeit list is invalid via, for example, user interface 26 and/or display monitor 50.

At step S224, the user is requested to obtain a replacement counterfeit list by visiting the manufacturer's website operating on server 32.

At step S226, the user obtains a new counterfeit list, for example, by downloading a new counterfeit list from server 32 into imaging driver 58 running on host 14.

Referring again to FIG. 3A, process flow proceeds back to step S212, where it is determined whether the cartridge identification number read in step S210 is on the counterfeit list downloaded in step S226. If so, cartridge 22 is deemed counterfeit and the user is notified, as set forth in steps S216 and S218 (FIG. 3C). Otherwise, process flow proceeds to step S214 (FIG. 3B), wherein normal printing is allowed.

While this invention has been described with respect to exemplary embodiments, it will be recognized that the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for detecting whether a cartridge installed in an imaging apparatus is potentially counterfeit, comprising:

determining whether a usage threshold has been reached by said cartridge;

determining whether said cartridge was previously installed in said imaging apparatus; and determining that said cartridge is potentially counterfeit if said usage threshold has been reached and said cartridge was not previously installed in said imaging apparatus.

2. The method of claim 1, wherein:

said determining whether said cartridge was previously installed in said imaging apparatus is determining whether said cartridge was previously installed in said imaging apparatus prior to said cartridge reaching said usage threshold; and said determining that said cartridge is potentially counterfeit if said usage threshold has been reached and said cartridge was not previously installed in said imaging apparatus is determining that said cartridge is potentially counterfeit if said usage threshold has been reached and said cartridge was not previously installed in said imaging apparatus prior to said cartridge reaching said usage threshold.

3. The method of claim 1, wherein if it is determined that said cartridge is potentially counterfeit, further comprising notifying a user of said imaging apparatus that said cartridge is potentially counterfeit.

4. The method of claim 1, further comprising:

performing an authentication of said cartridge; and determining that said cartridge is potentially counterfeit if said authentication fails.

5. The method of claim 1, wherein said usage threshold is one of a plurality of usage thresholds corresponding to a plurality of usages of said cartridge, the method further comprising:

performing an authentication of a second or subsequent usage of said plurality of usages of said cartridge; and determining that said cartridge is potentially counterfeit if said authentication of said second or subsequent usage fails.

6. The method of claim 1, wherein said determining whether said cartridge was previously installed in said imaging apparatus includes determining if a cartridge identification number associated with said cartridge is stored in a memory accessible by one of said imaging apparatus and a host computer communicatively coupled with said imaging apparatus.

7. The method of claim 6, wherein said memory is a memory of said imaging apparatus.

8. The method of claim 6, wherein said memory is a memory of said host computer.

9. The method of claim 6, wherein said determining if said cartridge identification number associated with said cartridge is stored in said memory includes:

reading said cartridge identification number from a cartridge memory associated with said cartridge;

comparing said cartridge identification number to a previous cartridge list stored in said memory of said imaging apparatus; and determining that said cartridge was not previously installed in said imaging apparatus if said cartridge identification number is not on said previous cartridge list.

10. A method for detecting whether a cartridge installed in an imaging apparatus is counterfeit, comprising determining whether a cartridge identification number associated with said cartridge is on a counterfeit list that is stored in a memory associated with one of said imaging apparatus and a host computer communicatively coupled with said imaging apparatus.

11. The method of claim 10, further comprising determining that said cartridge is counterfeit if said cartridge identification number is on said counterfeit list.

12. The method of claim 10, wherein if it is determined that said cartridge is counterfeit, further comprising notifying a user of said imaging apparatus that said cartridge is counterfeit.

13. The method for detecting whether a cartridge installed in an imaging apparatus is counterfeit, comprising:

determining whether a cartridge identification number associated with said cartridge is on a counterfeit list; and performing an authentication of said counterfeit list.

14. A method for detecting whether a cartridge installed in an imaging apparatus is counterfeit, comprising:

determining whether a cartridge identification number associated with said cartridge is on a counterfeit list, wherein said counterfeit list is a first counterfeit list;

receiving a second counterfeit list intended as a replacement for said first counterfeit list and a corresponding second version number; and performing an authentication of said second counterfeit list.

15. The method of claim 14, further comprising updating a first version number to generate said second version number.

16. The method of claim 14, further comprising determining that said second counterfeit list is invalid if said authentication fails.

17. The method of claim 14, wherein if said authentication fails, further comprising requesting a user to obtain a replacement counterfeit list.

18. The method of claim 14, wherein if said authentication does not fail, further comprising determining that said cartridge is counterfeit if said cartridge identification number is on said second counterfeit list.

19. The method of claim 14, further comprising determining that said second counterfeit list is invalid if said second version number is older than said a first version number.

20. A method for detecting whether a cartridge installed in an imaging apparatus is counterfeit, comprising:

determining whether a cartridge identification number associated with said cartridge is on a counterfeit list; and updating said counterfeit list when one of said imaging apparatus and a host computer communicatively coupled with said imaging apparatus contacts via a network a server associated with at least one of a manufacturer, a distributor, and a retailer of at least one of said imaging apparatus and said cartridge.

21. An imaging apparatus that detects whether a cartridge installed in said imaging apparatus is potentially counterfeit, comprising:

a print engine configured to mount said cartridge; and a controller communicatively coupled to said print engine, said controller being configured to execute instructions for:

determining whether a usage threshold has been reached by said cartridge;

determining whether said cartridge was previously installed in said imaging apparatus; and determining that said cartridge is potentially counterfeit if said usage threshold has been reached and said cartridge was not previously installed in said imaging apparatus.

22. The imaging apparatus of claim 21, wherein:

said determining whether said cartridge was previously installed in said imaging apparatus is determining whether said cartridge was previously installed in said imaging apparatus prior to said cartridge reaching said usage threshold; and said determining that said cartridge is potentially counterfeit if said usage threshold has been reached and said cartridge was not previously installed in said imaging apparatus is determining that said cartridge is potentially counterfeit if said usage threshold has been reached and said cartridge was not previously installed in said imaging apparatus prior to said cartridge reaching said usage threshold.

23. The imaging apparatus of claim 21, wherein if it is determined that said cartridge is potentially counterfeit, further comprising said controller being configured to execute instructions for notifying a user of said imaging apparatus that said cartridge is potentially counterfeit.

24. The imaging apparatus of claim 21, further comprising said controller being configured to execute instructions for:

performing an authentication of said cartridge; and determining that said cartridge is potentially counterfeit if said authentication fails.

25. The imaging apparatus of claim 21, wherein said usage threshold is one of a plurality of usage thresholds corresponding to a plurality of usages of said cartridge, further comprising said controller being configured to execute instructions for:

performing an authentication of a second or subsequent usage of said plurality of usages of said cartridge; and determining that said cartridge is potentially counterfeit if said authentication of said second or subsequent usage fails.

26. The imaging apparatus of claim 21, further comprising a memory, wherein said determining whether said cartridge was previously installed in said imaging apparatus includes determining if a cartridge identification number associated with said cartridge is stored in said memory.

27. The method of imaging apparatus 26, wherein said determining if said cartridge identification number associated with said cartridge is stored in said memory includes:

reading said cartridge identification number from a cartridge memory associated with said cartridge;

comparing said cartridge identification number to a previous cartridge list stored in said memory of said imaging apparatus; and determining that said cartridge was not previously installed in said imaging apparatus if said cartridge identification number is not on said previous cartridge list.

28. The imaging apparatus of claim 21, said imaging apparatus communicatively coupled with a host computer having access to a memory, wherein said determining whether said cartridge was previously installed in said imaging apparatus includes determining if a cartridge identification number associated with said cartridge is stored in said memory.

29. The method of imaging apparatus 28, further comprising a previous cartridge list stored in said memory, wherein said determining if said cartridge identification number associated with said cartridge is stored in said memory includes:

reading said cartridge identification number from a cartridge memory associated with said cartridge;

comparing said cartridge identification number to a previous cartridge list stored in said memory of said imaging apparatus; and determining that said cartridge was not previously installed in said imaging apparatus if said cartridge identification number is not on said previous cartridge list.

30. An imaging apparatus that detects whether a cartridge installed in an imaging apparatus is counterfeit, comprising:

a print engine configured to mount said cartridge; and a controller communicatively coupled to said print engine, said controller being configured to execute instructions for determining whether a cartridge identification number associated with said cartridge is on a counterfeit list that is stored in a memory associated with one of said imaging apparatus and a host computer communicatively coupled with said imaging apparatus.

31. The imaging apparatus of claim 30, further comprising said controller being configured to execute instructions for determining that said cartridge is counterfeit if said cartridge identification number is on said counterfeit list.

32. The imaging apparatus of claim 30, further comprising said controller being configured to execute instructions for notifying a user of said imaging apparatus that said cartridge is counterfeit if it is determined that said cartridge is counterfeit.

33. An imaging apparatus that detects whether a cartridge installed in an imaging apparatus is counterfeit, comprising:

a print engine configured to mount said cartridge; and a controller communicatively coupled to said print engine, said controller being configured to execute instructions for determining whether a cartridge identification number associated with said cartridge is on a counterfeit list, and said controller being configured to execute instructions for performing an authentication of said counterfeit list.

34. An imaging apparatus that detects whether a cartridge installed in an imaging apparatus is counterfeit, comprising:

a print engine configured to mount said cartridge; and a controller communicatively coupled to said print engine, said controller being configured to execute instructions for determining whether a cartridge identification number associated with said cartridge is on a counterfeit list, wherein said counterfeit list is a first counterfeit list having a first version number, said controller being configured to execute instructions for:

receiving a second counterfeit list intended as a replacement for said first counterfeit list and a corresponding second version number into a memory; and performing an authentication of said second counterfeit list.

35. The imaging apparatus of claim 34, further comprising said controller being configured to execute instructions for updating said first version number to generate said second version number.

36. The imaging apparatus of claim 34, further comprising said controller being configured to execute instructions for determining that said second counterfeit list is invalid if said authentication fails.

37. The imaging apparatus of claim 34, further comprising said controller being configured to execute instructions for requesting a user to obtain a replacement counterfeit list if said authentication fails.

38. The imaging apparatus of claim 34, further comprising said controller being configured to execute instructions for determining that said cartridge is counterfeit if said cartridge identification number is on said second counterfeit list.

39. The imaging apparatus of claim 34, further comprising said controller being configured to execute instructions for determining that said second counterfeit list is invalid if said second version number is older than said first version number.

40. An imaging apparatus that detects whether a cartridge installed in an imaging apparatus is counterfeit, comprising:

a print engine configured to mount said cartridge; and a controller communicatively coupled to said print engine, said controller being configured to execute instructions for determining whether a cartridge identification number associated with said cartridge is on a counterfeit list, and said controller being configured to execute instructions for updating said counterfeit list when one of said imaging apparatus and a host computer communicatively coupled with said imaging apparatus contacts via a network a server associated with at least one of a manufacturer, a distributor, and a retailer of at least one of said imaging apparatus and said cartridge.

* * * * *